US005271285A

United States Patent [19]

Silliman, Jr. et al.

[11] Patent Number: 5,271,285

[45] Date of Patent: Dec. 21, 1993

[54] HYDRAULIC STARTER

[75] Inventors: Loron E. Silliman, Jr., Watertown; Gregory J. Warner, Chadwicks; Howard E. Huber, Jr., Black River, all of N.Y.

[73] Assignee: General Signal Corporation, Stamford, Conn.

[21] Appl. No.: 909,151

[22] Filed: Jul. 6, 1992

[51] Int. Cl.[5] ..... F02N 7/00

[52] U.S. Cl. ..... 74/9; 74/6; 123/179.31

[58] Field of Search ..... 74/6, 7 R, 9; 123/179.31

[56] References Cited

U.S. PATENT DOCUMENTS

| | | | |
|---|---|---|---|
| 2,710,606 | 6/1955 | Jenny | 123/179.31 |
| 2,711,724 | 6/1955 | Jenny | 123/179.31 |
| 2,886,947 | 5/1959 | Jenny | 123/179.31 X |
| 3,130,540 | 4/1964 | Manning et al. | 123/179.31 X |
| 3,156,229 | 11/1964 | Manning | 123/179.31 |
| 3,170,450 | 2/1965 | Kent et al. | 123/179.31 |
| 3,654,758 | 4/1972 | Aoyama et al. | 123/179.31 X |

*Primary Examiner*—Leslie A. Braun
*Assistant Examiner*—William O. Trousdell
*Attorney, Agent, or Firm*—Ohlandt, Greeley & Ruggiero

[57] ABSTRACT

A hydraulic starter for gas turbine engines comprises a one piece shaft located in a motor cylinder block and having an internally splined end that extends outside of the cylinder block and is adapted to receive a coupling shaft that in turn engages a turbine shaft, a clutch concentrically mounted about the shaft in the cylinder block and shaft bearings also concentrically mounted about the shaft in the cylinder block. The starter also includes a valve plate and at least one outer bearing, and may include a spring member. The valve plate and the at least one outer bearing support the cylinder block.

17 Claims, 3 Drawing Sheets

HYDRAULIC STARTER

BACKGROUND OF THE INVENTION

1. Field of the Invention

The present invention relates to hydraulic starters and, more particularly, to an improved hydraulic starter for a gas turbine engine. The improved hydraulic starter of the present invention has a single, one piece shaft and a clutch positioned concentrically about the shaft in a motor cylinder block. The cylinder block is supported by a movable valve plate and an outer bearing.

The present hydraulic starter can be either a fixed displacement or a variable displacement starter. It can be used for gas turbine engines found in aircraft, marine and industrial applications, such as, for example, power generator stations.

Hydraulic starters for gas turbine engines have, heretofore, used a common hydraulic motor that has been modified to include a two piece shaft. The problem with the two piece shaft hydraulic starter is that engine acceleration exerts forces on the connected parts of the starter. These forces will cause the motor cylinder block to separate from the rigid valve plate.

In addition, the two piece shaft construction requires a larger clutch mechanism to engage the two shafts. Accordingly, the prior art starters are heavy in weight and large in size especially in the axial direction. This greater weight and size has been found to adversely affect performance.

2. Description of the Prior Art

Hydraulic starter systems that have a two piece shaft or equivalent, or a clutch or sprag-type clutch mechanism within the air starter, are known in the prior art. For example, U.S. Pat. No. 2,972,911, which issued on Feb. 28, 1961 to E. A. Volk, Jr., et al., entitled Starter and Accessory Drive, provides a turbine starter having planetary gearing connected through an overrunning sprag-type clutch to an engine connecting member. The sprag-type clutch is located within the starter housing, but adjacent the flange of the housing.

Also, U.S. Pat. No. 3,003,313, which issued on Oct. 10, 1961 to D. J. Bunger, entitled Turbine With Axially Moving Plane Of Rotation, provides another turbine motor that has a starter. The motor has an engine-connecting member that is connected to a drive member of the starter by a one-way coupling or overrunning sprag-type clutch. This patent provides a separate turbine shaft and separate helical spline that connects the shaft to the turbine blade.

U.S. Pat. No. 3,413,860, which issued on Dec. 3, 1968 to H. Heckt, entitled Compressed Air Starter Motor Of Rotary Piston Construction For Internal Combustion Engines, provides a compressed air starter motor that has a wedge body overrunning clutch positioned between a gear unit output member and a pinion shaft. In particular, the starter motor includes air driven rotors operatively connected to a drive pinion, an air operated meshing piston, a pinion shaft for mounting the drive pinion, a gear unit output member, a lever operatively connected between the meshing piston and the pinion shaft so that displacement of the meshing piston axially moves the pinion shaft, and a wedge body overrunning clutch positioned between the gear unit output member and the pinion shaft.

U.S. Pat. No. 4,699,095, which issued on Oct. 13, 1987 to J. Klie, et al., entitled Geared Compressed Air Starter, is directed to a gear-type compressed air starter that has a lead rotor, a driven rotor, a hollow shaft, a rotatable and axially displaceable engagement shaft provided in the hollow shaft, and a free-wheeling mechanism that serves to couple together the hollow shaft and engagement shaft. See also, U.S. Pat. No. 3,811,281, which issued on May 21, 1974 to J. A. Wise, et al., entitled Hydraulic Engine Starting Systems.

Lastly, U.S. Pat. No. 2,909,166, which issued on Oct. 20, 1959 to H. E. Cluff, et al., entitled Air Turbine Starter, is directed to an engine starter that has a drive shaft that remains engaged with the rotating structure of the engine and a gear train that drives an overrunning clutch through a first spline mechanism. The overrunning clutch has a second spline mechanism that serves to transmit motion from the clutch to the engine.

These prior art hydraulic starters fail to provide a one piece shaft construction that is incorporated into a motor cylinder block. Further, the prior art hydraulic starters are not as light in weight and as compact as the hydraulic starter of the present invention. Moreover, the prior art hydraulic starters fail to provide the performance achieved by the simple, one piece shaft construction of the present starter that overcomes the possibility of separation that would normally occur during start-up of the engine. Thus, the present hydraulic starter can be used at higher speeds than known prior art hydraulic starters.

SUMMARY OF THE INVENTION

It is a primary object of the present invention to provide a one piece shaft hydraulic starter.

It is another object of the present invention to provide such a hydraulic starter that can be adapted as either a fixed displacement or a variable displacement starter for gas turbine engines.

It is still another object of the present invention to provide such a hydraulic starter that avoids separation during acceleration thereby providing improved performance and reliability.

It is yet another object of the present invention to provide such a hydraulic starter that is light in weight and compact in size relative to known prior art hydraulic starters for gas turbine engines.

These and other objects are provided for by the hydraulic starter of the present invention. The hydraulic starter comprises a single shaft positioned in a motor cylinder block and having an end that extends out of the cylinder block and is adapted to receive a turbine spline coupling, a clutch concentrically mounted about the shaft and a bearing also located about the shaft in the motor cylinder block. The starter also includes a movable valve plate and an outer bearing to support the cylinder block.

BRIEF DESCRIPTION OF THE DRAWINGS

The foregoing and still other objects and advantages of the present invention will be more apparent from the following detailed explanation of the preferred embodiments of the invention in connection with the accompanying drawings wherein.

DESCRIPTION OF THE PREFERRED EMBODIMENTS

Figure 1:
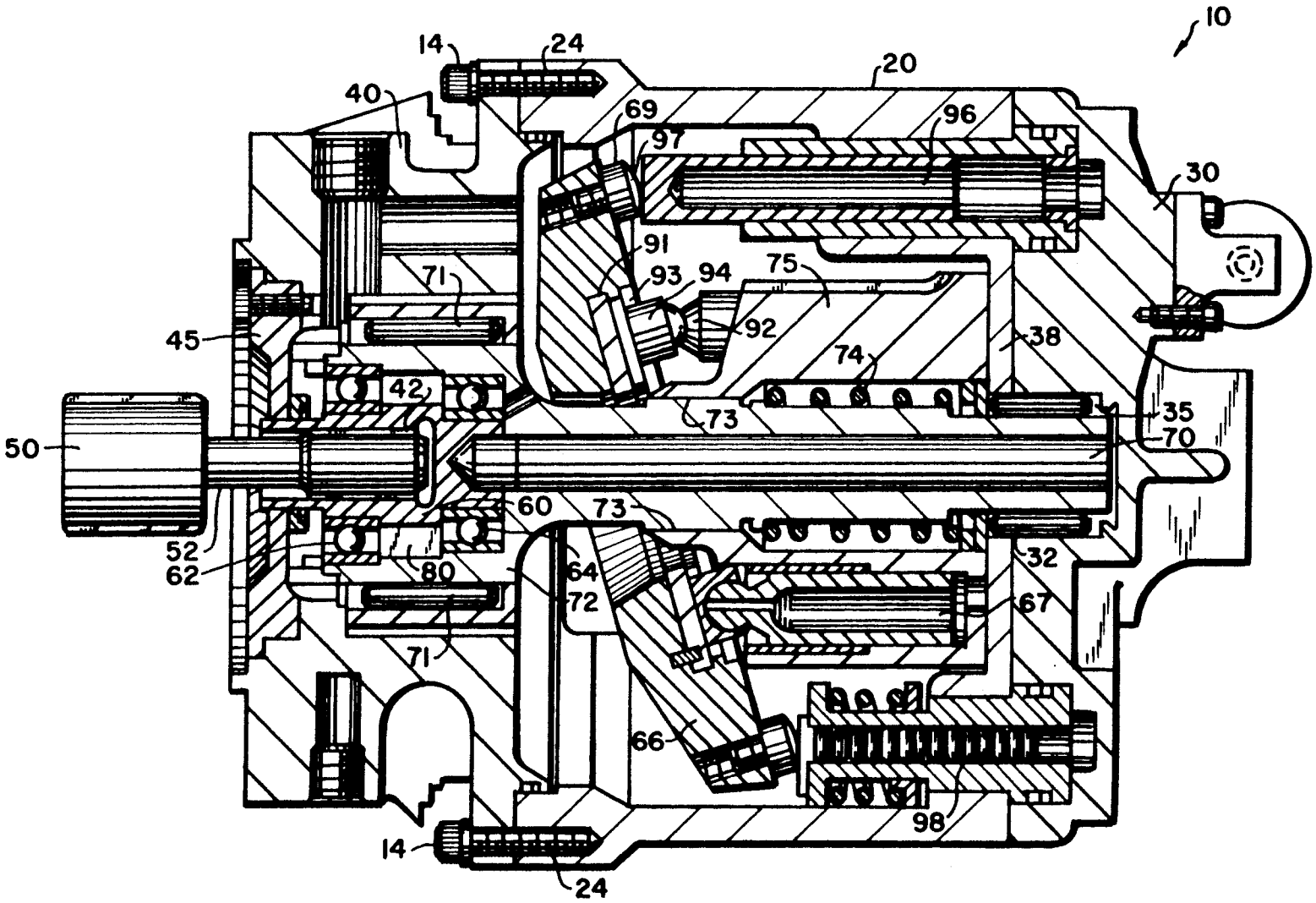
FIG. 1 is a cross sectional view of a prior art variable displacement hydraulic starter.

Referring to the drawings and, in particular, to FIG. 1, a variable displacement starter of the prior art is generally represented by reference numeral 10. The starter 10 includes a housing or body 20, a cover 30 that is secured to the body, a flange 40 that is also removably secured to the body, and a seal plate 45 that is removably secured to the flange.

The cover 30 has a central recess 35. The flange 40 and the seal plate 45 have a central opening through which an outer shaft 60 and a coupling shaft 52 are located. The coupling shaft 52 is connected to an outer shaft 60 by splined end 42 and to the turbine shaft by a splined end 50. The flange 40 is secured to the housing 20, by conventional fasteners or connectors, such as, for example, by threaded bolts or screws 14 that are adapted to be received in threaded areas 24 in the housing.

In axial alignment with the outer shaft 60 is a second or inner shaft 70. The shaft 70, which is an axial shaft through a motor cylinder block 75, has an enlarged end 72 that extends into the flange 40 and is supported by antifriction bearing 71 when the starter 10 is assembled.

Located between the enlarged end 72 of the inner shaft 70 and the outer shaft 60 is an overrunning clutch assembly consisting of a clutch 80, a first bearing 62 and a second bearing 64. The clutch 80 operatively engages the outer shaft 60 to the inner shaft 70 upon activation of the motor.

The first bearing 62 and the second bearing 64 provide for relatively friction free rotation of the outer shaft 60 in the enlarged end 72 of the inner shaft 70 during turbine operation.

The inner shaft 70 is the drive shaft that passes through the cylinder block 75 located in the housing 20 and through an opening in a fixed valve plate 38 and into the recess 35 of cover 30. Antifriction bearings or bearing assemblies 32, analogous to the first bearing 62 and the second bearing 64, are placed in the recess 35 about the end of the inner shaft 70 to permit relatively friction free rotation of the inner shaft.

The starter 10 also includes a cam 66, a plurality of piston assemblies (only one of which is shown) that includes a piston 92 that emits from the motor cylinder block 75, a piston shoe 94 that is connected to the piston, a return plate 93 and a wear plate 91. The cylinder block 75 is operatively connected to the inner shaft 70 by mating splines 73. Between the cylinder block 75 and the inner shaft 70 is a block spring 74 that forces the cylinder block against a fixed valve plate 38.

Since this prior art starter is a variable displacement starter, there is also provided an axial control piston assembly 96 to vary the angular position of the cam 66. Accordingly, the axial control piston assembly 96 has an end 97 that is adapted to contact a cam surface 69 secured to the cam 66. In addition, a counterbalance piston assembly 98 controls the angular position of the cam 66 and also limits the angular displacement of the cam.

Figure 2:
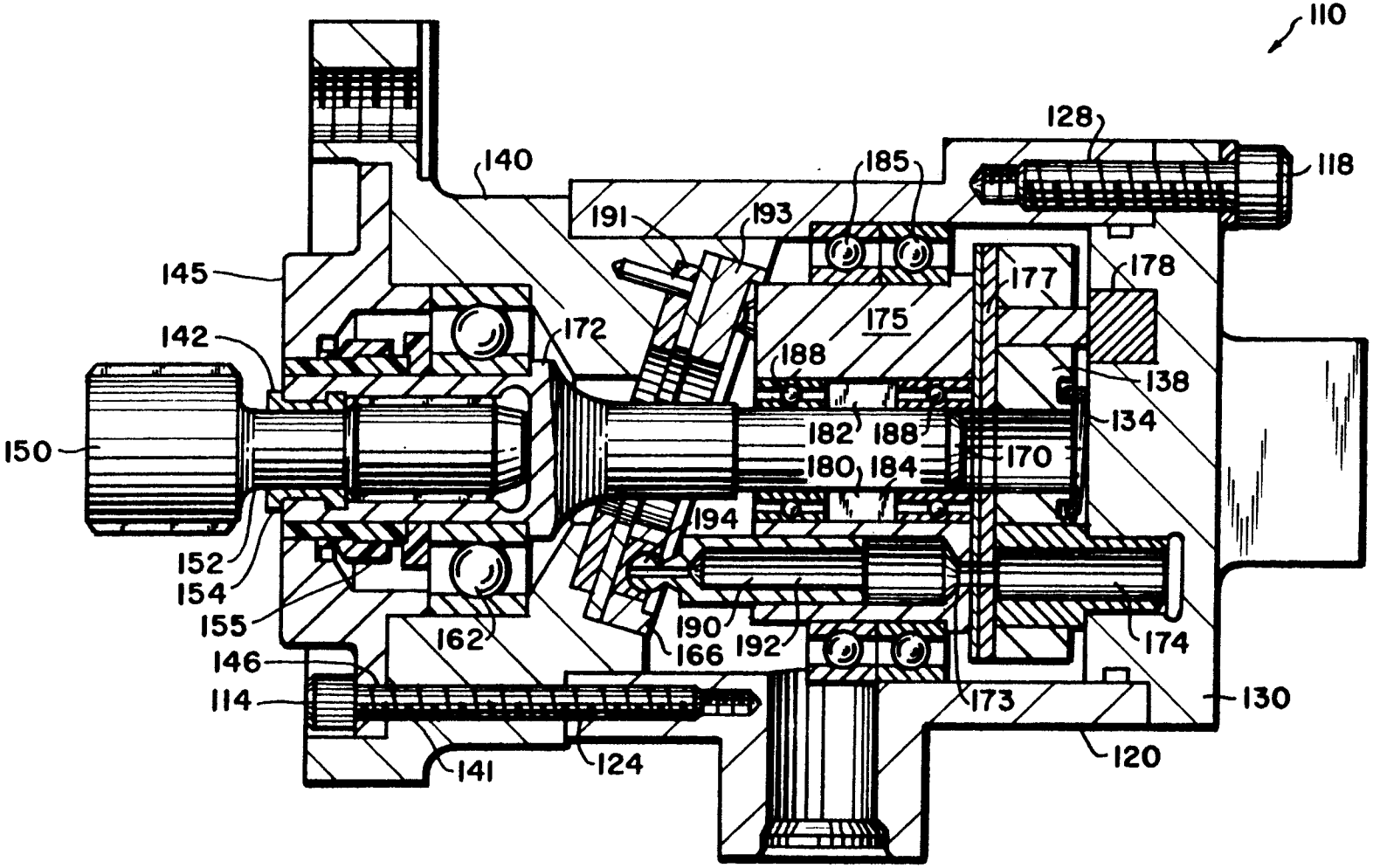
FIG. 2 is a partial cross sectional view of the hydraulic starter of the present invention as a fixed displacement starter.
Figure 3:
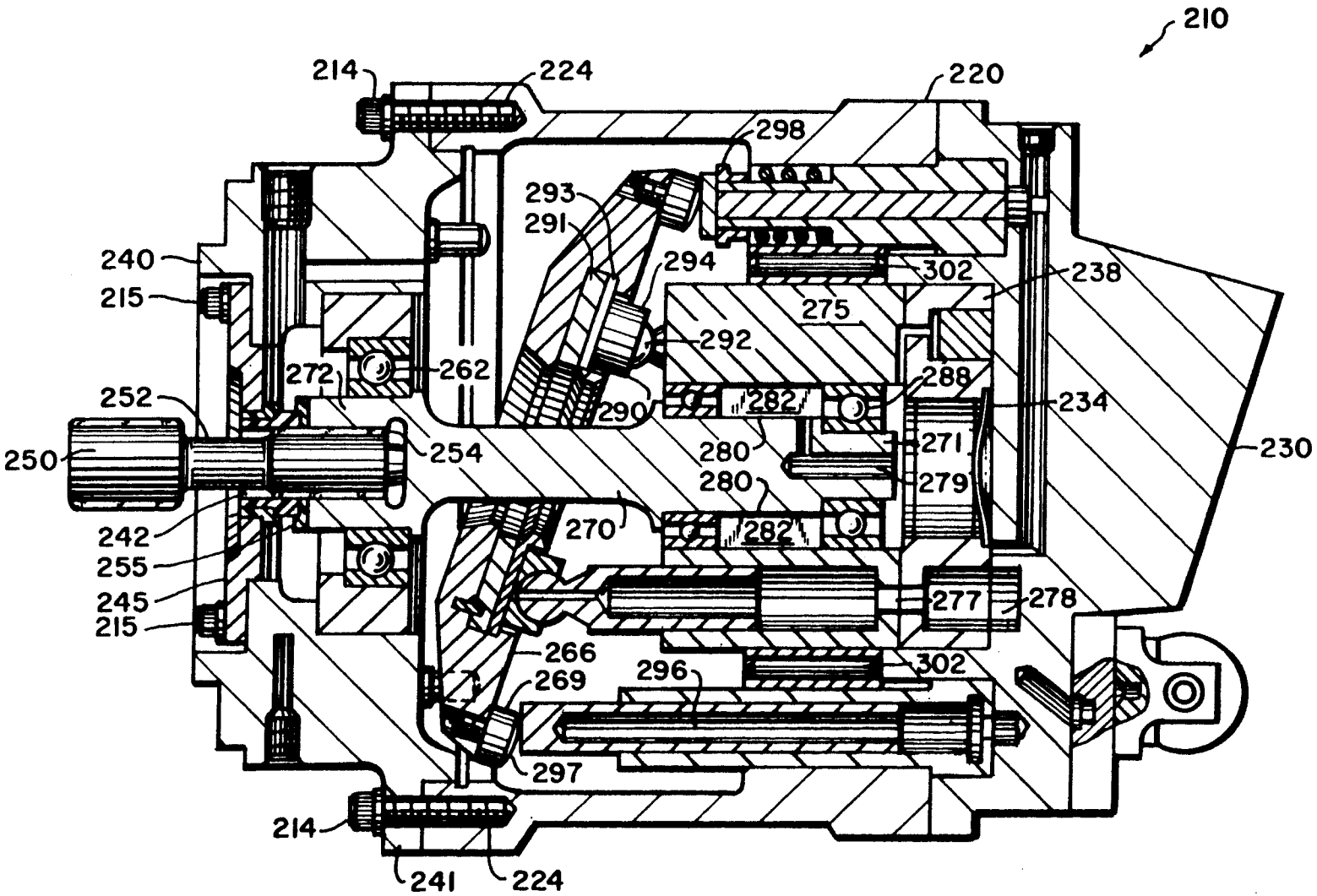
FIG. 3 is a partial cross sectional view of the hydraulic starter of the present invention as a variable displacement starter.

The hydraulic starter 10 of the present invention is better suited as a fixed displacement hydraulic starter as shown in FIG. 2. It is, however, effective as a variable displacement hydraulic starter as shown in FIG. 3.

Referring to the present invention as a fixed displacement hydraulic starter as shown in FIG. 2, the starter 110 includes a housing or body 120, a cover 130, a flange 140 and a seal plate 145. The housing 120 includes at least one screw thread area 124 for receipt of a threaded bolt or screw 114. The screw 114 passes through a portion 146 of the seal plate 145 and a portion 141 of the flange 140 into a threaded area 124 in order to connect the seal plate to the flange and the flange to the housing.

At least one threaded bolt or screw 118 is adapted to be received in a second threaded area 128 of the housing 120 in order to connect the cover 130 to the housing.

The flange 140 and the seal plate 145 have a central opening adapted to receive therethrough a sleeved end 172 of the shaft 170 and a coupling shaft 152. A splined end 150 of the coupling shaft 152 connects to the turbine (not shown).

The present invention includes a unitary shaft 170. The unitary shaft 170 is elongated and includes the annular grooved or sleeved end 172 that, when assembled, is located in the flange 140 and completely through the seal plate 145. The sleeved end 172 is splined for operative connection to the splined inner end of the coupling shaft 152.

A retainer 154 is provided to retain the coupling shaft 152 in the end 172. Also, at least one mechanical seal is provided to prevent or minimize the leaking of fluid. Preferably, the mechanical seal is a mechanical ring seal assembly 155 positioned about the end 172 and the seal plate 145. The mechanical ring seal 155 can be made of any conventional material, such as, for example, steel, bronze and rubber, that acts to provide a fluid tight seal.

A single radial bearing 162 is placed concentrically about the end 172 in the flange 140 to provide for relatively friction free rotation of the shaft 170.

Towards the other end of shaft 170 opposite the end 172, a clutch pak 180 is positioned concentrically about the shaft 170. The clutch pak 180 is positioned in the motor cylinder block 175. In this embodiment, the clutch pak 180 includes a clutch 182. As the cylinder block 175 rotates, the clutch 182 engages the shaft 170 and commences the rotation of the shaft to start-up the engine. The clutch 182 disengages the shaft 170 from the motor cylinder block 175 at the end of the start-up cycle.

Two radial bearings 188 are positioned about the shaft 170 contiguous with and on each side of the clutch 182 in the motor cylinder block 175. The bearings 188, like the bearing 162, provide for relatively friction free rotation of the shaft 170.

A movable valve plate 138 is positioned at the end of the shaft 170 adjacent the cover 130. The movable valve plate 138 is in sealing contact with the cylinder block 175. A spring member 134 is positioned between the cover 130 and the valve plate 138. The spring member 134 operates on the valve plate 138 to maintain the seal between the valve plate and the cylinder block 175. The valve plate 138 is, preferably, made of steel.

There are a plurality, preferably nine, of motor piston assemblies 190, only one of which one is shown. Each motor piston assembly 190 includes a piston 192 that is connected to a shoe 194, and each assembly is situated in the motor cylinder block 175. The motor piston assembly 190 is connected to a wear plate 191 and a return plate 193 secured to the cam 166. In a preferred embodiment, the wear plate 191 and the piston 192 are made of steel. The piston shoe 194 is preferably made of bronze.

A first fluid passageway or port 174 is connected to a kidney 173 that passes through the valve plate 138. The first port 174 is a high pressure port that provides from the cover 130 high pressure fluid into the motor cylinder block 175. The high pressure fluid axially displaces the piston 192 to create a force that is transmitted to a stationary inclined cam 166. The reaction of this force produces a rotational effect that causes the cylinder block 175 and the piston therein to rotate about the centerline of the starter 10. The continued flow of the high pressure fluid maintains the piston 192 in contact with the cam 166 until the maximum pressure stroke position is reached. At the maximum pressure stroke, the cylinder port aligns with a first discharge port of the valve plate 138. The piston 192, which is started on its return stroke by a reaction force from the cam 166, displaces the hydraulic fluid from the cylinder to a second or discharge port similar to the first port. The piston 192 is maintained in contact with the piston shoe 194 and, thus, the cam 166 by the return plate 193.

A pair of outer bearings 185 are positioned between the interior of the housing 120 and the starter components, namely the motor cylinder block 175 and the motor piston assembly 190. These outer bearings 185 along with the valve plate 138 act to maintain the cylinder block 175 in place especially during operation.

The radial bearings 162 and 188 that provide for the relatively friction free rotation of the shaft 170 are, preferably, ball or roller bearings. In this embodiment, the pair of outer bearings 185 are, preferably, ball bearings.

The fixed displacement starter of FIG. 2 basically comprises the axial shaft 170 with its annular splined end 172, the piston assemblies 190, the clutch pak 180 and the radial bearings 188. The clutch 180 and the radial bearings 188 are concentrically positioned about the shaft 170 and are located in the motor cylinder block 175. The fixed displacement starter also includes the movable valve plate 138 and at least one outer bearing 185, and the spring member 134.

Referring to FIG. 3, which is the variable displacement embodiment of the hydraulic starter of the present invention, the starter 210 includes a housing or body 220, a cover 230, a flange 240 and a seal plate 245. The housing 220 includes screw thread areas 224 for receipt of threaded bolts or screws 214. The screws 214 pass through a portion 241 of the flange 240 into the threaded areas 224 in order to connect the flange to the housing. A second set of bolts or screws 215 are adapted to engage second screw thread areas of the flange 240.

Likewise, conventional means, such as, for example, bolts or screws are adapted to be received in one or more second threaded areas of the housing 220 in order to connect the cover 230 to the housing.

The flange 240 and the seal plate 245 have a central opening 242. The central opening 242 is adapted to receive therethrough the coupling shaft 252 and a unitary shaft 270.

The starter 210 includes the unitary, elongated shaft or shaft assembly 270 having an end 271 adjacent the cover 230 and having a radially, inwardly projecting, annular internally splined end 272 that, when assembled, is located in the flange 240. The splined end 272 is adapted to receive the inner splined end of the coupling shaft 252. The outer splined end 250 of the coupling shaft 252 connects to a turbine shaft.

A first or front radial bearing 262 is positioned about the splined end 272 in the flange 240 to provide for relatively friction free rotation of the splined end of the shaft 270.

As with the FIG. 2 embodiment, a clutch pak 280 is positioned concentrically about the shaft 270. In the embodiment shown, the clutch pak 280 includes a clutch 282 and rear bearings 288. The clutch 282 provides the operative connection of the cylinder block 275 and the shaft 270 during the starter's operation.

The rear radial bearings 288 provide relatively friction free rotation of a cover end 271 of the shaft 270 during turbine operation. The radial bearings 262 and 288 are, preferably, ball bearings. The cover end 271 of the shaft 270 includes a passageway 279 therein to provide for the lubrication of the clutch 282.

A retainer coupling 254 is located about the edge of the splined end 272 and about the coupling shaft 252 to retain the coupling shaft in the splined end of the shaft 270. A mechanical packing or ring seal 255 is provided about the splined end 272 and the seal plate 245 to provide a fluid tight engagement. The mechanical packing seal 255, as the mechanical seal 155 in the FIG. 2 embodiment, can be made of any conventional material.

As with the FIG. 2 starter, there is a plurality of motor piston assemblies 290, only one of which is shown. Each motor piston assembly 290 is operatively connected to the motor cylinder block 275. The motor piston assembly 290 includes a piston 292 and a piston shoe 294 connected to the piston. A wear plate 291 and a return plate 293 are connected to the cam 266 and can be considered a part of the motor piston assembly 290. The wear plate 291, the return plate 293 and the piston 292 are, preferably, made of steel. The piston shoe 294 is, preferably, made of bronze.

A fluid passageway or high pressure port 278 is connected to a kidney 277 that passes through a movable valve plate 238. The port 278 provides the high pressure fluid from the cover 220 to the piston 292 to axially displace the piston. A force is thus transmitted to the inclined cam 266 and the reaction of this force produces a rotational effect that causes rotation of the motor cylinder block 275 and the piston therein. The continued flow of high pressure fluid maintains the piston 292 in contact with the cam 266 until the maximum pressure stroke position is reached whereat the piston, that is started on its return stroke by a reaction force from the cam, displaces the hydraulic fluid from the cylinder into a discharge port that is similar in configuration to the high pressure port.

In the variable displacement starter of FIG. 3, there is also provided an axial control piston assembly 296 that is adapted to vary the axial displacement or angular position of the cam 266. The axial control piston assembly 296 has an end 297 that is adapted to contact a surface or second shoe 269 on the cam 266. In addition, a counterbalance piston assembly 298 assists the control of the cam 266 and also limits the angular displacement of the cam.

A bearing 302 is positioned about the motor cylinder block 275 to hold, along with the movable valve plate 238, the motor cylinder block 275 in place. In this embodiment, the bearing 302 is preferably a roller bearing.

The movable valve plate 238 is positioned between the cover 230 and the shaft 170 in sealing contact with the motor cylinder block 275. The movable valve plate 238 is, preferably, made of steel. Spring members 234 are positioned between the cover 230 and the movable valve plate 238 and operate on the valve plate to maintain the seal between the valve plate and the cylinder block 275.

The variable displacement starter of FIG. 3, like the fixed displacement starter of FIG. 2, comprises the shaft 270, the housing 220, the clutch 282 and the bearings 288. The clutch 282 and the bearings 288 are concentrically positioned about the shaft 270 in the motor cylinder block 275. The variable displacement starter also includes the movable valve plate 238 and the roller bearing 302. The starter 210 also includes spring members 234.

The present invention may, of course, be carried out in other specific ways than those set forth herein without departing from the spirit and essential characteristics of the present invention. The present embodiments are, therefore, to be considered in all respects as illustrative and not restrictive, and to provide for all changes coming within the meaning and equivalency range the appended claims are intended to embrace.

Wherefore we claim:

1. A hydraulic starter for gas turbine engines adapted to be positioned in a motor cylinder block, the starter comprising:

a one piece shaft positioned in the cylinder block and having an annular internally splined end that extends outside of the cylinder block and is adapted to receive a coupling shaft which in turn engages a turbine shaft;

a clutch positioned concentrically about the one piece shaft, said clutch being operatively connected to the cylinder block and adapted to selectively engage the one piece shaft;

first means, positioned concentrically about the one-piece shaft, for relatively friction free rotation of the one-piece shaft;

second means, positioned concentrically about the one-piece shaft and positioned in the cylinder block, for relatively friction free rotation of the one-piece shaft;

a movable valve plate being positioned between the one-piece shaft and a cover, wherein the movable valve plate is in sealing engagement with the cylinder block; and outer bearing means positioned about the cylinder block, wherein the outer bearing means and the valve plate support the cylinder block.

2. The hydraulic starter of claim 1, wherein the valve plate is positioned in sealing engagement with the cylinder block.

3. The hydraulic starter of claim 2, further comprising spring means adapted to maintain the valve plate in sealing engagement with the cylinder block.

4. The hydraulic starter of claim 1, wherein the outer bearing means is an outer bearing.

5. The hydraulic starter of claim 1, wherein the outer bearing means is a pair of outer bearings.

6. The hydraulic starter of claim 4, wherein the outer bearing is a ball bearing.

7. The hydraulic starter of claim 1, further comprising a plurality of second shaft bearings, and wherein the clutch and the plurality of second shaft bearings form a clutch pak.

8. The hydraulic starter of claim 1, wherein the hydraulic starter is a fixed displacement starter.

9. The hydraulic starter of claim 1, wherein the hydraulic starter is a variable displacement starter.

10. A fixed displacement hydraulic starter for gas turbine engines, the starter comprising:

a frame including a housing, a cover removably connected to the housing, a flange removably connected to the housing and a seal plate removably connected to the flange;

a cam positioned in the frame;

a motor piston assembly positioned in the frame, the piston assembly including a piston, a piston shoe connected to the piston, a cylinder block within which the piston axially slides, the cylinder block being positioned in the housing and operatively connected to the cam, a wear plate and a return plate, wherein the wear plate and the return plate are connected to the cam;

means for providing high pressure hydraulic fluid into the cylinder block to axially slide the piston against the cam;

means for discharging low pressure hydraulic fluid;

a one piece shaft positioned in the cylinder block and having an annular internally splined end that extends outside of the cylinder block into the flange and is adapted to receive a coupling shaft that in turn engages a turbine shaft;

means, positioned concentrically about the shaft and operatively connected to the cylinder block, for selectively engaging the shaft;

first means, positioned concentrically about the shaft and positioned in the flange, for relatively friction free rotation of the shaft;

second means, positioned concentrically about the shaft and positioned in the cylinder block, for relatively friction free rotation of the shaft;

a movable valve plate being positioned between the shaft and the cover in sealing engagement with the cylinder block; and outer bearing means positioned about the cylinder block, wherein the outer bearing means and the valve plate support the cylinder block.

11. The hydraulic starter of claim 10, further comprising a spring means positioned between the valve plate and the cover, wherein the spring means is adapted to maintain the valve plate in sealing engagement with the motor cylinder block.

12. The hydraulic starter of claim 10, wherein the first means is a single bearing, and the second means is a pair of bearings.

13. The hydraulic starter of claim 10, wherein the outer bearing means is a pair of bearings.

14. A variable displacement hydraulic starter for gas turbine engines, the starter comprising:

a frame including a housing, a cover removably connected to the housing, a flange removably connected to the housing and a seal plate removably connected to the flange;

a cam positioned in the frame;

means for adjusting the angular position of the cam;

a motor cylinder block being positioned in the housing;

a motor piston assembly positioned in the frame and operatively connected to the cam, the piston assembly including a piston and a piston shoe connected to the piston and also connected to the cam;

a wear plate and a return plate, wherein the wear plate and the return plate are connected to the cam;

means for providing high pressure hydraulic fluid into the cylinder block to axially slide the piston against the cam;

means for discharging low pressure hydraulic fluid;

a one piece shaft positioned in the cylinder block and having an annular internally splined end that extends outside of the cylinder block into the flange and is adapted to receive a coupling shaft that in turn engages a turbine shaft;

means, positioned concentrically about the shaft and operatively connected to the cylinder block, for selectively engaging the shaft;

first means, positioned concentrically about the shaft and positioned in the flange, for relatively friction free rotation of the shaft;

second means, positioned concentrically about the shaft and positioned in the cylinder block, for relatively friction free rotation of the shaft;

a movable valve plate being positioned between the shaft and the cover in sealing engagement with the cylinder block; and outer bearing means positioned about the cylinder block, wherein the outer bearing means and the valve plate support the cylinder block in the housing.

15. The hydraulic starter of claim 14, further comprising a spring means positioned between the valve plate and the cover, wherein the spring means is adapted to maintain the valve plate in sealing engagement with the motor cylinder block.

16. The hydraulic starter of claim 14, wherein the first means is a single bearing, and wherein the second means is a pair of bearings.

17. The hydraulic starter of claim 14, wherein the outer bearing means is a pair of bearings.

* * * * *